US005469637A

United States Patent [19]

Adam

[11] Patent Number: 5,469,637

[45] Date of Patent: Nov. 28, 1995

[54] RAIN LEGGINGS

[76] Inventor: James R. Adam, 344 Camp Rd., Cocoa, Fla. 32927

[21] Appl. No.: 254,269

[22] Filed: Jun. 6, 1994

[51] Int. Cl.[6] ..... A43B 5/00

[52] U.S. Cl. ..... 36/2 R; 36/2 B; 36/1.5; 36/7.2; 36/131

[58] Field of Search ..... 36/2 R, 2 A, 2 B, 36/1.5, 7.2, 7.4, 131

[56] References Cited

U.S. PATENT DOCUMENTS

| | | | |
|---|---|---|---|
| 2,438,308 | 3/1948 | Wheaton | 36/2 R |
| 2,506,245 | 5/1950 | Stanton | 36/7.2 |
| 2,657,477 | 11/1953 | Winslow | 36/2 R |
| 2,872,745 | 2/1959 | Finegan | 36/2 R |
| 3,304,629 | 2/1967 | Meyers | 36/2 R |
| 3,812,606 | 5/1974 | Merola | 36/72 R |
| 4,110,845 | 9/1978 | Chellis | 36/2 R |
| 4,458,363 | 7/1984 | Harvey | 2/22 |
| 4,503,566 | 3/1985 | Wheeler | 2/22 |
| 4,509,213 | 4/1985 | Harvey | 2/22 |
| 4,599,812 | 7/1986 | Harmsen | 36/1.5 |
| 4,665,562 | 5/1987 | Winer | 36/2 R |
| 5,168,644 | 12/1992 | Ellis | 36/72 R |
| 5,173,967 | 12/1992 | Carter | 2/242 |

FOREIGN PATENT DOCUMENTS

| | | | |
|---|---|---|---|
| 59440 | 6/1913 | Austria | 36/2 R |
| 1027798 | 5/1953 | France | 36/2 R |
| 26525 | of 1903 | United Kingdom | 36/2 R |
| 1724 | of 1915 | United Kingdom | 36/2 R |

OTHER PUBLICATIONS

Harvey Davidson, The Harvey Davidson Motorclothes and Collectables Spring Supplement to the 1994 Catalog–Brochure, p. 12, Jan. 1994.

*Primary Examiner*—Paul T. Sewell
*Assistant Examiner*—Marie Denise Patterson
*Attorney, Agent, or Firm*—Brian S. Steinberger

[57] ABSTRACT

Adaptable flexible protective leggings for protecting motorcycle and bicycle riders from the deleterious effects of rain storms and wet roads is disclosed. The leggings includes a molded flexible leg material that conforms generally to the shape of a rider's leg having an open area in back where at least one strap with Velcro type fasteners connects the leg material to the rider's leg. The leg material can run from just above the knee cap to the ankle of the rider where it is connected to a molded flexible shoe material that conforms to at least the front portion of the rider's shoes. The shoe material can be sized to fit over boots, shoes, sneakers, moccasins and the like. The shoe material is generally designed to leave the heel and rear of the shoe exposed. Optionally, the shoe material can include a thickened area with grooves beneath the sole of the shoe portion to aid in traction and increased durability of the shoe material as well as a thickened portion above the toes in the area where the the rider is shifting gears on a motorcycle. The molded material can be formed from waterproof materials such as robber, plastic, vinyl and the like and can include portions that are transparent. Optionally, space on the leg material can be reserved for advertising type logos. The leggings can be easily carried in a folded or rolled condition.

17 Claims, 3 Drawing Sheets

RAIN LEGGINGS

This invention relates to lightweight and foldable rain gear, and in particular to protecting the lower legs and feet of motorcycle and bicycle riders from the effects of rain water.

BACKGROUND AND PRIOR ART

People riding motorcycles and bicycles during rain storms or immediately thereafter are often exposed to injurious effects to their clothing and their health from these wet riding conditions. While sitting on both a motorcycle or a bicycle the lower leg of the rider is in a vertical position. During or soon after a rain storm, both the front of the lower leg and the front of the shoes are in the direct path of the water spray and splash caused from the front wheel rolling through puddles on wet roads. Motorcycle riders often wear expensive boots that can be mined by being exposed to this constant spray of splashing water. Likewise, bicycle riders often wear expensive footwear such as sneakers that can be ruined by constantly being exposed to this splashing water. Further, a cycle riders pants can be soaked from tiding through these conditions. Besides ruining clothes, the continued exposure to wet clothes caused by the constant spray can increase the rider's chances of catching sickness and colds.

People have worn baggy nylon type water repellant garments to protect their clothes and body from the effects of rain for many years. Often these garments include either or both a baggy nylon type jacket and baggy nylon type pants, which are sometimes referred to as rain suits. However, these suits have been inadequate and are unsuitable to protect riders of motorcycles and bicycles from the inherent splashing that occurs from riding through puddles during or after rain storms. These baggy rain suits have inherent problems that make them unsuitable for use by cycle riders. For example, the baggy nature of a nylon type material reduces the aerodynamic needs of a cyclist. Further, rain suits are hot and cumbersome, and not easy to carry. Further, the baggy appearance of these suits is unsightly for many motorcycle and bicycle riders. A still another problem is that the baggy nature of nylon type pants can be dangerous to a cyclist. For example, a bicycle rider risks the chances that the baggy pants leg can get caught in the chains, pedals, guards and spokes of the bicycle. A motorcycle rider risks the same problems as the bicycle rider with additional problems. Since nylon type materials are highly flammable and the hot exhaust pipes and engine of motorcycles are located near the legs of the rider, the rider risks getting physically burned by wearing baggy flammable materials. Further, portions of baggy nylon rain gear that contact an engine and exhaust pipes are destroyed. A still another problem is that nylon type materials have generally been thin and thus prone to tearing and thus are not adequately durable over time. The increased wind effect on motorcycle and bicycle riders further decreases the life span of nylon type materials. A still another problem with using baggy nylon type pants is their flimsy material offers little insulation when a cyclist is riding in cold weather.

Thus, the need exists for adequately and safely protecting the legs and shoes of motorcycle and bicycle riders from rain conditions.

SUMMARY OF THE INVENTION

The first objective of the present invention is to provide waterproof protection for legs and shoes of cycle riders such as those riding motorcycles and bicycles.

The second object of this invention is to provide legging and shoe protection for a cycle rider that is pleasing to the eye and not unsightly.

The third object of this invention is to provide legging and shoe protection that is safe for a cycle rider.

The fourth object of this invention is to provide legging and shoe protection for a cycle rider that is aerodynamic.

The fifth object of this invention is to provide legging and shoe protection for a cycle rider that is durable under riding conditions.

The sixth object of this invention is to provide legging and shoe protection for a cycle rider that is easy to pull-on and take-off.

The seventh object of this invention is to provide legging and shoe protection for a cycle rider that can permit easy carrying in a folded or rolled condition.

The eighth object of this invention is to provide legging and shoe protection that helps insulate a rider's lower leg from cold weather.

A preferred embodiment of the leggings includes a molded flexible pants leg material connected to a molded flexible shoe material. The molded flexible leg material conforms generally to the shape of a rider's leg having an open area in back where at least one strap with hook and loop fasteners such as Velcro, that connects the leg material to the rider's leg. The leg material can run from just above the knee cap to the ankle of the rider where it is connected to the molded flexible and expandable shoe material that conforms to at least the front portion of the rider's shoes. The shoe material can be sized to fit over boots, shoes, sneakers, moccasins and the like. The shoe material is generally designed and fabricated to leave the heel and rear of the shoe exposed. The shoe material can include a thickened area with grooves beneath the sole of the shoe portion to aid in traction as well as a thickened portion above the toe portion in the area where the the rider is shifting gears on a motorcycle. The molded material can be formed from rubber, plastic, vinyl, and the like and can include portions that are transparent. A space on the leg material can be reserved for advertising type logos and the like.

Since the described leggings invention is formed as a complete unit from molding durable rubber materials and adding straps with fasteners, the invention avoids the problems inherent to materials such as baggy type nylon.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
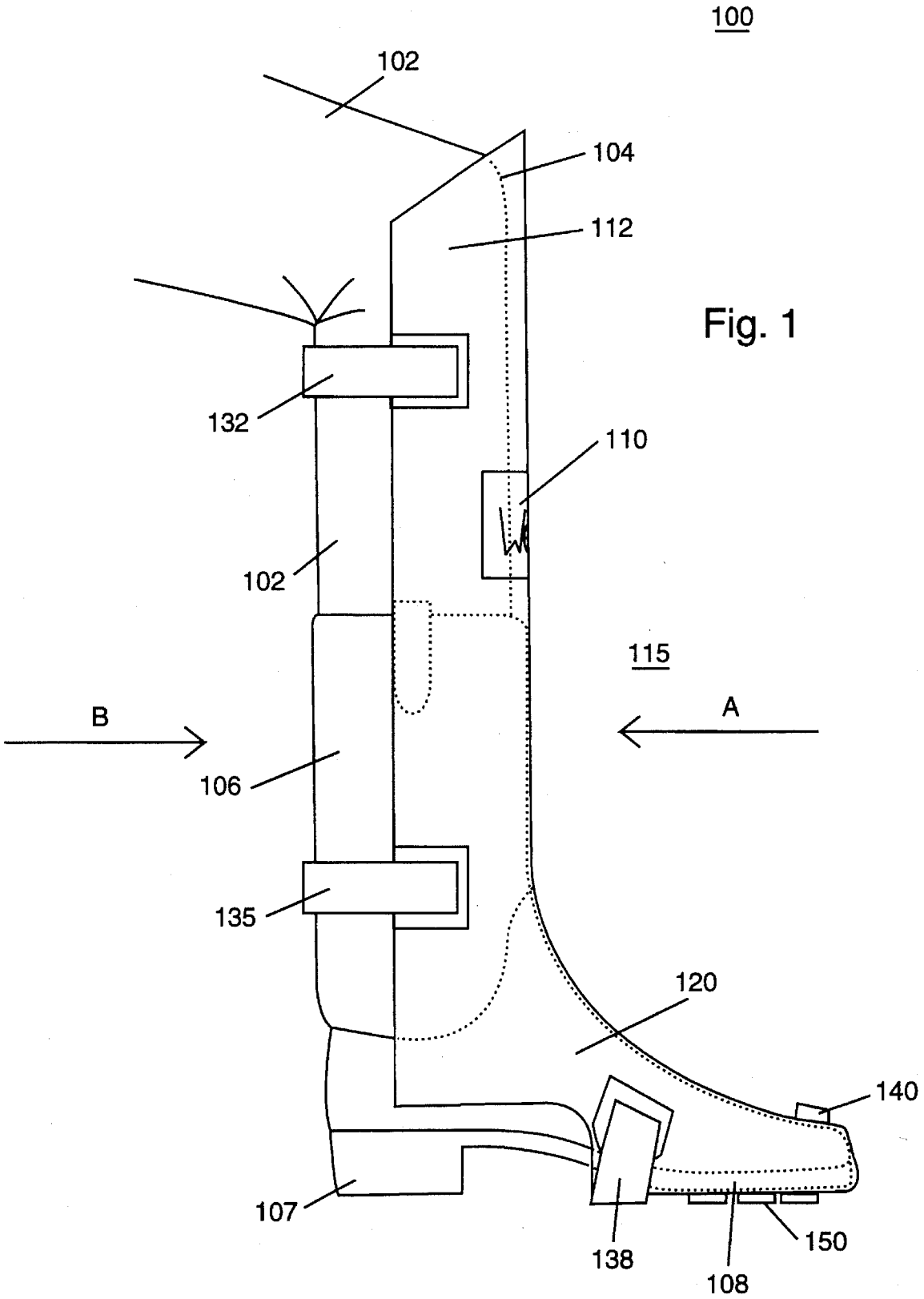
FIG. 1 shows a side view of a preferred embodiment of the leggings assembled over a pants leg and boot.
Figure 2A:
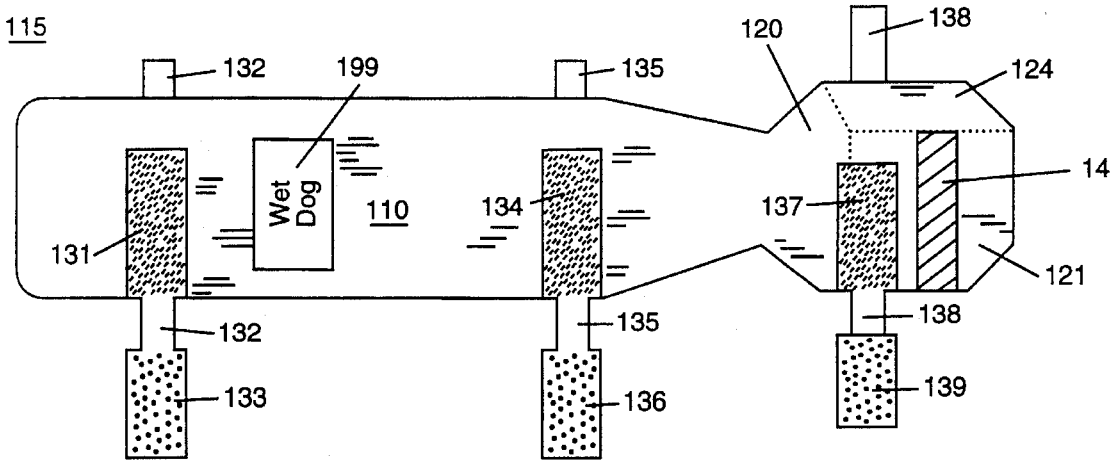
FIG. 2A shows a front view of the leggings of FIG. 1 along arrow A in an unassembled position.
Figure 2B:
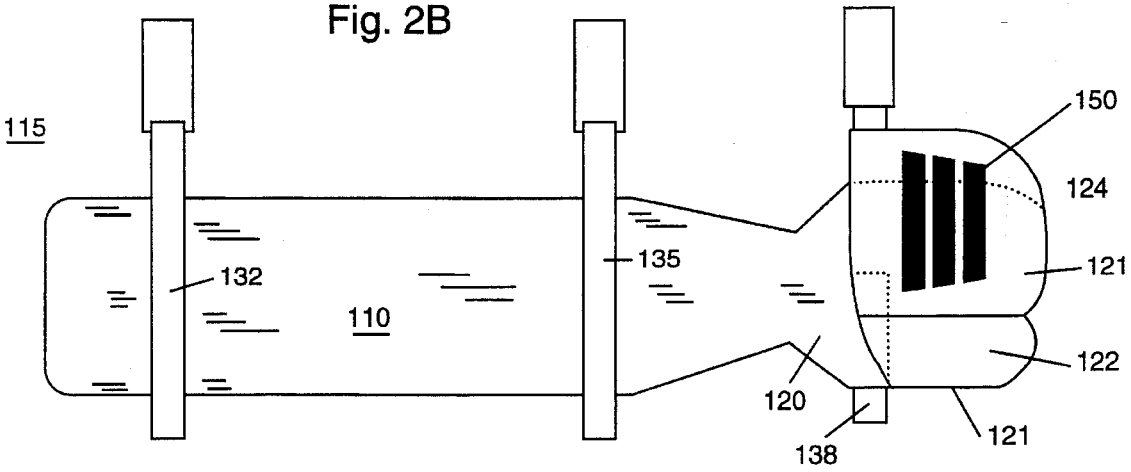
FIG. 2B shows a rear view of the leggings of FIG. 1 along arrow B in an unassembled position.

FIG. 1 shows a side view of a preferred embodiment 100 of the leggings 115 assembled over a straight type pants leg 102 and boot 106. FIG. 2A shows a front view of the leggings 115 of FIG. 1 along arrow A in an unassembled position. FIG. 2B shows a rear view of the leggings 115 of FIG. 1 along arrow B in an unassembled position. A description of the components of the leggings 115 will now be described.

Referring to FIGS. 1, 2A and 2B, leggings 115 comprises a molded flexible rubber type leg material section 110 connected to a molded flexible rubber shoe coupling material 120. Waterproof rubber materials such as pure natural rubber, latex, neoprene, vinyl, PVC, plastic and the like. Alternatively, both the leg material section and the shoe material section can be molded or cut from one piece of material such as one being approximately 36" long by 10" wide and approximately 1/64 to 3/32 inches thick. Useful molding techniques include but are not limited to injection molding and the like. Referring to FIGS. 1, 2A and 2B, the entire legging 115 can be sleek black in color or transparent in pans.

Referring to FIGS. 2A and 2B, the pocket and receptacle section 124 can be formed from various molds to approximate the front portions of various size ranges of boots, shoes, sneakers, and the like, in order to make a conforming fit. For example, a men's shoe sizes of 8.5" to 10.5" can be a medium, a small can include shoe sizes less than 8.5", and a large can include shoe sizes larger than 10.5", and the like. Pocket and receptacle section 124 covers and protects the front of the rider's shoes which because of their position by a cycle rider are most exposed to weather conditions. Further, section 124 restricts air flow from getting under and lifting leggings 115. Leggings 115 and pocket 124 can be shaped to approximate left and fight shoes.

Figure 2C:
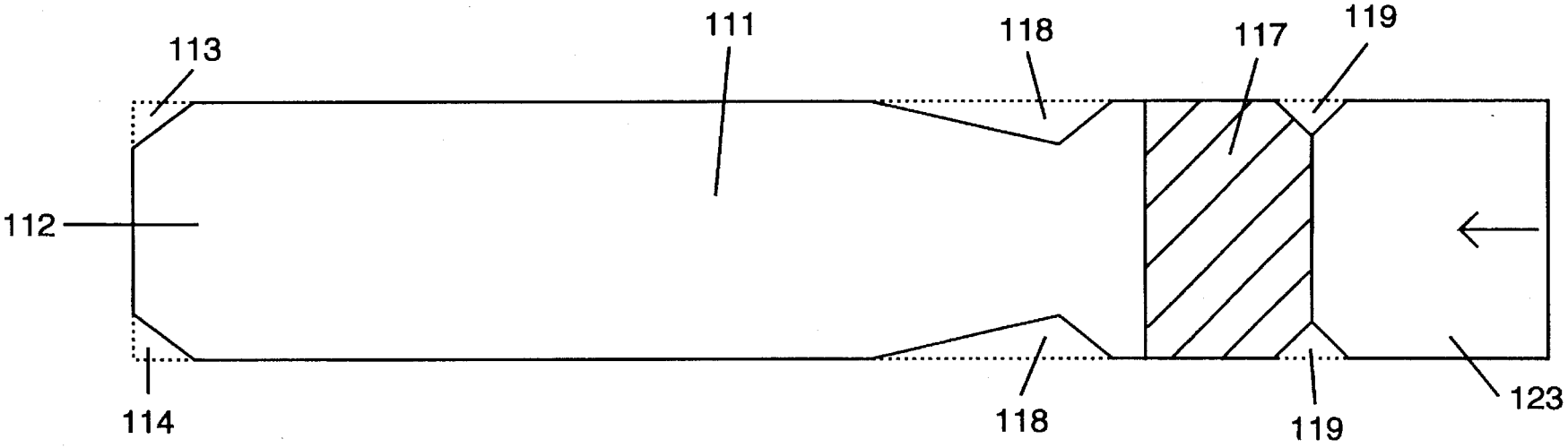
FIG. 2C shows the base material used for the leggings of FIG. 2A and 2B before being cut.

Referring to FIGS. 2A and 2B, the leggings 115 can alternatively be cut from a rectangular piece of flexible waterproof material. Referring to FIG. 2C, a jig or block of wood 117 approximately 6" long, 4" wide and 3" high, can be laid down on a flat sheet of waterproof material 111 of approximately 36 inches by 10 inches and approximately 1/64 to 1/16 inches thick. Triangular shaped pieces 118, (sometimes called darts) can be cut from sides of the material 111, where the vertical knee portion meets the shoe portion of the material and two more areas 119 to round the toe area. Material 123 to form the bottom of the shoe portion can be folded over the jig 117. Edges 113 and 114 can be trimmed around knee portion 112. Then material for sides 122(See FIG. 2B) can be connected to bottom side 123 and top side 121 by staples, rivets, tape and sewing stitches to form the pocket and receptacle portion 124.

Referring to FIGS. 2A and 2B, pocket and receptacle portion 124 can include a thicker material layer 150 of approximately 1/64 to 3/16 inches of material at the bottom to be adjacent the sole area of one's shoes to aid in traction. Alternatively, a roughened pad, canvass or nonrusting grommets such as brass, stainless steel and the like can be used for enhancing traction and product durability for walking and for stopping the cycle.

Optionally, the top 121 of receptacle and pocket portion 124 can include a thicker area of material 140 approximately an inch or more wide between approximately 1/64 and 1/8 inches thick stretching across the top towards the toe area formed from materials such as rubber or canvass and the like. This additional material is to primarily aid a motorcyclist when shifting gears since the gear shift is normally located adjacent the top of the left pedal of a motorcycle.

Referring to FIGS. 2A and 2B, straps 132, 135 and 138 include hook section fasteners 133, 136, 139 respectively, and loop section fasteners 131,134 and 137, respectively. Straps 132, 135 and 138 can be approximately one to two inches thick and up to approximately eight inches and longer with enough material to wrap completely around the leg as needed. Straps 132, 135, and 138 are formed from flexible material such as but not limited to rubber, plastic, vinyl, nylon, dipped cloth material, leather, or other elastic materials and combinations thereof. Straps 132, 135 and 138 can be attached to the pant leg material 1 10 and to the shoe portion material 120 by adhesives such as glue, sewing stitches, and the like. The preferred location of strap 132 can be approximately under the knee and over the calf section of the user. The suggested location of strap 135 can be just above the ankle of the user. Finally, the approximate location of strap 138 can be square to rear of pocket 120 and forward of the arch and over the instep of a user. These locations can vary according to the alternative sizes that are made.

Assembling the leggings 115 of FIGS. 1, 2A and 2B will now be described. Referring to FIGS. 2A and 2B, the straps 132, 135, and 138 of leggings 115 are initially disconnected. Referring to FIG. 1, the cycle rider initially puts the toe portion of their shoe or boot 108 into the receptacle or pocket portion 124 while leaving the heel portion 107 of the shoe or boot 106 exposed. Next, the legging 115 is adjusted so that the pant leg portion 110 is positioned in from of the pants leg 102 up to and coveting the knee area 104. Alternatively, the knee area 112 of the pants leg portion 110 can be cut as desired for use by shorter people, etc. Next, straps 132, 135 and 138 are wrapped around the rear of pants leg 102 and fastened in their respective hooks and loops.

Figure 3:
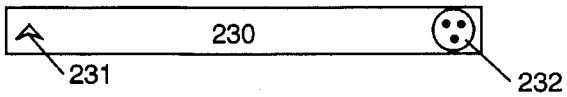
FIG. 3 shows a view of an alternative button strap for use with the leggings of FIG. 1.

FIG. 3 shows an expanded view of an alternative button strap 230 with button hole 231 and button 232 that can be substituted for some or all of the straps 132, 135, and 138 of FIG. 1.

Figure 4:
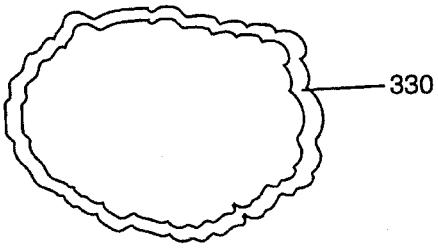
FIG. 4 shows an expanded view of an alternative continuous elastic band strap for use with the leggings of FIG. 1.

Similarly, FIG. 4 shows an expanded view of an alternative continuous elastic band strap 330 that can be substituted for some or all of the straps 132, 135, and 138 of FIG. 1.

While the preferred embodiment depicts three straps for securing the leggings, more or less straps can used as needed.

While the preferred embodiment describes using molded rubber as the material for the invention, other types of molded materials are also applicable. For example, welded plastics, vinyl, cloth dip molded in PVC or neoprene rubber, molded synthetic composites, and the like.

Preferably, the material used in the leggings should be flexible, pliable and durable so as to permit folding or rolling of the material for ease in carrying in pants pockets, jacket pockets, purses, knapsacks, tool kits, saddle bags and the like.

While the molded flexible material used in the preferred embodiment of the legging is described as being sleek black or transparent, the color of the material used can include other colors such as red, yellow, brown, blue, glow in the dark shades and the like. Additionally, various colored reflector stickers with tape backings can be added for safety.

Further, a portion of the leggings can include space for manufacturer logos 199 FIG. 2A and the like.

Although the preferred embodiment is described for molding about straight type pants legs, the type of pant's legs can further include form fitting pants and bell bottoms.

Although the embodiments have been described as molding the shoe portion about shoes, boots and sneakers, other types of shoes can also be used such as sandals, moccasins and the like.

Although the preferred embodiment has been described using straps with hook and loop fasteners such as Velcro, buttons, and elastic bands, other types of fasteners can be used such as but not limited to snaps, buckles and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An adaptable lower leg and shoe protector for motorcycle and bicycle riders that is sleek, aerodynamic and water resistant comprising:

a molded elongated flexible pant leg section that curves about a front area of a lower leg of a cycle rider, and a rear area of the lower leg being substantially uncovered, the pant leg section substantially covering the front of the lower leg from an ankle to a knee cap of the cycle rider; and a molded flexible shoe coupling section for fitting about a front tip portion and substantially covering an entire shoe of the cycle rider, the shoe coupling section having an opening to allow a heel of the shoe to be exposed, the shoe coupling section substantially covering from the front tip portion of the shoe over the shoe top to the ankle of the cycle rider, the shoe coupling section being connected to the leg section near the ankle of the cycle rider, wherein both the leg section and the shoe coupling section protect the front of the lower leg and the tip portion and shoe top of the cycle rider from splashing water; and a raised molded pad located on a top area of the shoe coupling section, whereby the pad is positioned to contact a gear shift of the cycle.

2. The adaptable leg and shoe protector of claim 1, further comprising:

a molded flexible pant leg section, a molded flexible shoe coupling section and a molded pad for the fight leg and fight shoe of the cycle rider; and a molded flexible pant leg section, a molded flexible shoe coupling section and a molded pad for the left leg and left shoe of the cycle rider.

3. The adaptable leg and shoe protector of claim 1, wherein the pant leg section shoe coupling section and pad are molded from:

rubber.

4. The adaptable leg and shoe protector of claim 1, wherein the pant leg section shoe coupling section and pad are molded from:

plastic.

5. The adaptable leg and shoe protector of claim 1, wherein the pant leg section shoe coupling section and pad are molded from:

vinyl.

6. The adaptable leg and shoe protector of claim 1, wherein the pant leg section shoe coupling section and pad are molded from:

dipped cloth.

7. The adaptable leg and shoe protector of claim 1, further including:

a first strap across the uncovered rear area of the lower leg adjacent to the ankle;

a second strap across the uncovered rear area of the lower leg adjacent to the kneecap; and a third strap across a lower surface of the shoe adjacent to the heel.

8. The adaptable leg and shoe protector of claim 7, wherein the first strap the second strap and the third strap includes:

hook and loop fasteners.

9. The adaptable leg and shoe protector of claim 1, wherein the shoe coupling section further includes:

a thicker portion beneath a sole portion of the shoe.

10. The adaptable leg and shoe protector of claim 9, wherein the shoe coupling section further includes:

a roughened area in the thicker portion to increase traction and durability of the shoe coupling section.

11. The adaptable leg and shoe protector of claim 1, wherein a portion of the pant leg section is:

transparent.

12. The adaptable leg and shoe protector of claim 1, wherein a portion of the shoe coupling section is:

transparent.

13. The adaptable leg and shoe protector of claim 1, further comprising:

a portion for attaching a logo.

14. The adaptable lower leg and shoe protector of claim 1, wherein the lower leg section, the shoe coupling section, and the raised pad are formed by:

injection molding.

15. A lower leg and shoe protector for motorcycle and bicycle riders capable of being carried in a folded or rolled condition comprising:

an elongated flexible pant leg section formed by injection molding that curves about a front area of a lower leg of a cycle rider, the leg section having an open uncovered back area behind the leg of the cycle rider, the leg section covering and protecting the knee area to the ankle of the rider's leg;

a flexible shoe coupling section formed by injection molding for fitting about a front tip portion and substantially covering an entire shoe of the cycle rider, the shoe coupling section being connected to the leg section, the shoe coupling section having an opening for allowing a heel of the shoe to be exposed, wherein both the pant leg section and the shoe coupling section protect the front area of the lower leg and the tip portion and shoe top of the cycle rider from splashing water a first strap attached by hook and loop fasteners across the uncovered back area of the lower leg adjacent to the ankle;

a second strap attached by hook and loop fasteners across the uncovered back area of the lower leg adjacent to the kneecap:

a third strap attached by hook and loop fasteners across a lower surface of the shoe adjacent to the heel; and a raised pad formed by injection molding located on a top area of the shoe coupling section, whereby the pad is positioned to contact a gear shift of the cycle, and wherein the leg section, the shoe coupling section and the raised pad being foldable and rollable together.

16. An adaptable lower leg and shoe protector for motorcycle riders that is sleek, aerodynamic and water resistant comprising:

a molded elongated flexible pant leg section that curves about a front area of a lower leg of a rider for a motorcycle, the pant leg section leaving a back portion of the leg uncovered;

a molded flexible shoe coupling section for fitting about a front tip portion and substantially covering an entire shoe of the motorcycle rider, the shoe coupling section having an opening for leaving a heel of the shoe exposed;

a raised molded pad located on a top area of the shoe coupling section, whereby the pad is positioned to contact a gear shift of the motorcycle; and a thickened molded portion with grooves located on a sole portion of the shoe coupling section, wherein the pant leg section and the shoe coupling section are resistant to splashing water.

17. The adaptable lower leg and shoe protector of claim 16, wherein the lower leg section, the shoe coupling section, the raised pad and the thickened sole portion are formed by:

injection molding.

* * * * *